US012247799B1

(12) United States Patent
Spence

(10) Patent No.: US 12,247,799 B1
(45) **Date of Patent: *Mar. 11, 2025**

(54) PAINTBALL GUN BARREL WITH VARIABLE SIZED MAGNA PORTS

(71) Applicant: Daniel Spence, Rockledge, FL (US)

(72) Inventor: Daniel Spence, Rockledge, FL (US)

( * ) Notice: Subject to any disclaimer, the term of this patent is extended or adjusted under 35 U.S.C. 154(b) by 6 days.

This patent is subject to a terminal disclaimer.

(21) Appl. No.: 18/243,962

(22) Filed: Sep. 8, 2023

Related U.S. Application Data

(63) Continuation-in-part of application No. 17/824,962, filed on May 26, 2022, now Pat. No. 11,774,207.

(51) Int. Cl.

| | |
|---|---|
| ***F41A 21/48*** | (2006.01) |
| ***F41A 21/10*** | (2006.01) |
| ***F41A 21/28*** | (2006.01) |
| ***F41B 11/62*** | (2013.01) |

(52) U.S. Cl.
CPC ..... *F41A 21/28* (2013.01); *F41A 21/10* (2013.01); *F41A 21/482* (2013.01); *F41B 11/62* (2013.01)

(58) Field of Classification Search
CPC ..... F41A 11/02; F41A 11/04; F41A 11/06; F41A 21/04; F41A 21/10; F41A 21/44
See application file for complete search history.

(56) References Cited

U.S. PATENT DOCUMENTS

| | | | | |
|---|---|---|---|---|
| 1,772,505 | A * | 8/1930 | Wells | F41A 21/04 89/16 |
| 3,708,841 | A * | 1/1973 | Quinney | F41A 11/02 124/84 |
| 4,641,450 | A * | 2/1987 | Moll | C23C 14/0641 138/140 |
| 6,494,195 | B2 * | 12/2002 | Perry | F41B 11/00 42/76.01 |
| 6,668,815 | B1 * | 12/2003 | Fernandez | F41A 11/00 285/341 |
| 6,698,128 | B2 * | 3/2004 | Kessler | F41B 11/00 89/14.05 |
| 7,076,905 | B2 * | 7/2006 | Zouboulakis | F41A 21/482 42/76.01 |
| 8,910,411 | B1 * | 12/2014 | Calvert | F41A 21/325 42/105 |
| 9,091,502 | B1 * | 7/2015 | Morrison | F41G 11/001 |
| 9,587,909 | B1 * | 3/2017 | Askin | F41F 1/00 |
| 11,236,961 | B1 * | 2/2022 | Pineda | F41A 21/482 |
| 2003/0041849 | A1 * | 3/2003 | Perry | F41A 21/04 124/84 |

(Continued)

*Primary Examiner* — Derrick R Morgan
(74) *Attorney, Agent, or Firm* — Peter Loffler

(57) ABSTRACT

A barrel system for a paintball gun allows a user to quickly change the magna porting size of the barrel without the need to switch the barrel. A peg is located on an outer surface of the barrel as is a first port. A barrel tip has a second port aligned with a first channel and a third port of a different size relative to the second port, the third port aligned with a second channel. The barrel is received within the barrel tip so that the peg is either received within the first channel and thereby overlaying the second port with the first port, or the peg is received within the second channel and thereby overlaying the third port with the first port. An additional of port of yet another size as well as a null port may be provided, each with its own aligned channel.

18 Claims, 10 Drawing Sheets

(56) References Cited

U.S. PATENT DOCUMENTS

| | | | | |
|---|---|---|---|---|
| 2003/0182838 | A1* | 10/2003 | Kessler | F41A 21/00 42/79 |
| 2005/0183712 | A1* | 8/2005 | Goepfert | F41B 11/00 124/83 |
| 2006/0064914 | A1* | 3/2006 | Greer | F41A 11/02 42/77 |
| 2006/0101697 | A1* | 5/2006 | Bushnell | F41A 21/16 42/76.01 |
| 2006/0249130 | A1* | 11/2006 | Ho | F41B 11/00 124/1 |
| 2010/0154764 | A1* | 6/2010 | Liao | F41A 9/55 124/44.7 |
| 2011/0000474 | A1* | 1/2011 | Wood | F41A 11/02 29/401.1 |
| 2012/0144713 | A1* | 6/2012 | Dubois | F41A 21/482 42/50 |
| 2013/0139715 | A1* | 6/2013 | Bleicken | F42B 3/22 102/311 |
| 2014/0007857 | A1* | 1/2014 | Schlosser | F41B 11/70 124/84 |
| 2018/0080733 | A1* | 3/2018 | Battaglia | F41A 21/484 |
| 2018/0202736 | A1* | 7/2018 | Teetzel | F41A 11/02 |
| 2018/0283821 | A1* | 10/2018 | Dodson | F41A 21/12 |
| 2020/0141682 | A1* | 5/2020 | McMillan | F41A 21/10 |
| 2021/0041201 | A1* | 2/2021 | Seghi | F41A 21/484 |
| 2021/0404785 | A1* | 12/2021 | Sasnett | F42D 5/04 |
| 2023/0022445 | A1* | 1/2023 | Painter | F41A 21/44 |

* cited by examiner

PAINTBALL GUN BARREL WITH VARIABLE SIZED MAGNA PORTS

This application is a Continuation-in-Part of U.S. patent application Ser. No. 17/824,962 filed on May 26, 2022, which application is incorporated herein in its entirety.

BACKGROUND OF THE INVENTION

1. Field of the Invention

The present invention relates to paintball gun system that allows a user to vary the size of the magna port vents on the barrel of the gun.

2. Background of the Prior Art

In order to fire a projectile out of a gun, a gas is rapidly expanded behind the projectile with the expanding gas pushing the projectile down the barrel of the firearm at a high rate of speed, eventually pushing the projectile out through the muzzle and hopefully on to the intended target. In the case of a bullet in a traditional firearm, the expanding gas is created by striking a primer within the casing which causes gun powder therein to ignite, thereby creating the expanding gas that pushes the bullet down the barrel and out through the muzzle. In the case of a paintball gun, the expanding gas is created by discharging a small amount of carbon dioxide held within a carbon dioxide cartridge in a compressed state. In either case, the gas is at very high pressure and expands at a high rate of speed, so that the projectile is discharged from the firearm at a high rate of speed in order to effectively travel down range.

A problem occurs at the transitional phase of projectile travel. As the projectile reaches the muzzle of the barrel of the gun, the expanding gases behind the projectile are still at a very high pressure. As the projectile exits the muzzle, breaking the seal within the barrel, the expanding gases are free to move past the discharged projectile and travel in all directions. If the gases are at sufficiently high pressure, a problem can occur as the gases moving past the projectile may do so asymmetrically. As the gases are still exerting a force onto the projectile as they move past the projectile, such asymmetric gas travel may cause the projectile to be "pushed" off its intended flight path.

In order to limit the possibility of the expanding gases from exerting an unwanted force immediately after the transitional period, magna porting has been proposed. Magna porting involves the placement of one or more openings within the barrel proximate the muzzle end. The magna ports allow much of the expanding gases to escape the barrel through the magna ports instead of exiting the barrel via the muzzle. As the gases have exerted the substantial majority of force onto the projectile at this point, there is little loss in velocity performance of the projectile. As a large portion of the expanding gases exits via the magna ports, there is a reduced amount of gas that exits the barrel via the muzzle. With a reduced amount of gas exiting the barrel via the muzzle, the potential for this reduced amount of gas adversely affecting the projectile is greatly reduced.

Magna porting works great in many instances, but in the field of paintball guns, there is room for improvement. Bullets have an extremely high level of consistency between each round so that each round fired can be expected to have the expanding gas be at the same level of pressure at the magna ports. As such, a manufacturer of a firearm can calculate the size of the magna ports needed with a fairly high level of precision for optimal performance. Unfortunately, the same does not hold true for paintball guns. There can be significant variations in the pressure exerted by the expanding carbon dioxide between cartridges and even within a single cartridge depending on how full the cartridge is. It is not uncommon during paintball gun play, especially during tournament play, to see participants change the barrel of a gun in order to change the size of the magna porting on the barrel to address the then current state of pressure being provided by the carbon dioxide cartridge in order to achieve optimal performance from the gun.

In my previous patent application, I invented a system for rapid barrel swap out of a paintball gun. The primary driver behind my previous application was to allow rapid change-out of the bore size of the barrel to match the size of the paintball being fired. My previous invention can also be used to change a barrel to one having the desired size of magna porting for the situation then at hand. However, doing so would require the user to have an inordinately large collection of barrels on hand. The user would be required to have one barrel for each bore size intended to be used and within each bore size, one barrel each for the size of magna porting anticipated. While functionally effective, such would be cumbersome not only in the transport of the various barrels during play, but also barrel selection during swap out.

What is needed is a system that allows a paintball player to be able to change the effective magna port size of the barrel in relatively quick and easy fashion without the need to change the barrel as is the case when changing the bore size. Such a system must be easy to implement so that a player can perform the bore swap very fast.

SUMMARY OF THE INVENTION

The paintball gun barrel with variable sized magna ports of the present invention addresses the aforementioned needs in the art by providing a system whereby the effective magna port size of the paintball gun barrel can be changed in just a few seconds without the need to change the barrel. The paintball gun barrel with variable sized magna ports is quick and easy to implement and piggybacks off of my previously mentioned invention while also being usable with conventional paintball gun barrels. The paintball gun barrel with variable sized magna ports is of relatively simple design and construction, making the system relatively inexpensive to produce using standard manufacturing techniques making the system economically attractive to potential consumers for this type of device. The paintball gun barrel with variable sized magna ports continues to allow for aesthetic customization of the paintball gun.

The paintball gun barrel with variable sized magna ports of the present invention is comprised of a hollow tubular barrel that has breach end that is removably attached to the discharge port of the paintball gun. The barrel also has an opposing muzzle end and an outer surface. At least one peg is located on the outer surface of the barrel. The barrel has a series of first ports proximate the muzzle end. A hollow tubular barrel tip has a first inner surface, a coupling end, and a port end. A first channel is disposed within the first inner surface of the barrel tip extending from the coupling end toward the port end while a second channel is disposed within the first inner surface of the barrel tip extending from the coupling end toward the port end, the second channel spaced apart from the first channel. A series of second ports is located on the barrel tip proximate the port end and longitudinally aligned with the first channel. The second ports are of a first size. A series of third ports is located on the barrel tip proximate the port end and longitudinally aligned with the second channel and radially spaced apart from the series of second ports. The third ports are of a second size that is different relative to the first size. The barrel is received within the barrel tip so that the peg is received within either the first channel or the second channel so that if the peg is received within the first channel, the second ports overlay the first ports and if the peg is received within the second channel, the third ports overlay the first ports. A third channel may be disposed within the first inner surface of the barrel tip extending from the coupling end toward the port end such that the peg may be received within the third channel when the barrel is received within the first hollow interior of the barrel tip instead of the first channel or the second channel. The barrel has a first inside diameter at the breach end and a second inside diameter located at the muzzle end such that the second diameter may be greater than the first diameter. The second inner surface of the barrel may have a friction reducing coating thereon.

BRIEF DESCRIPTION OF THE DRAWINGS

Similar reference numerals refer to similar parts throughout the several views of the drawings.

DESCRIPTION OF THE PREFERRED EMBODIMENT

Figure 1:
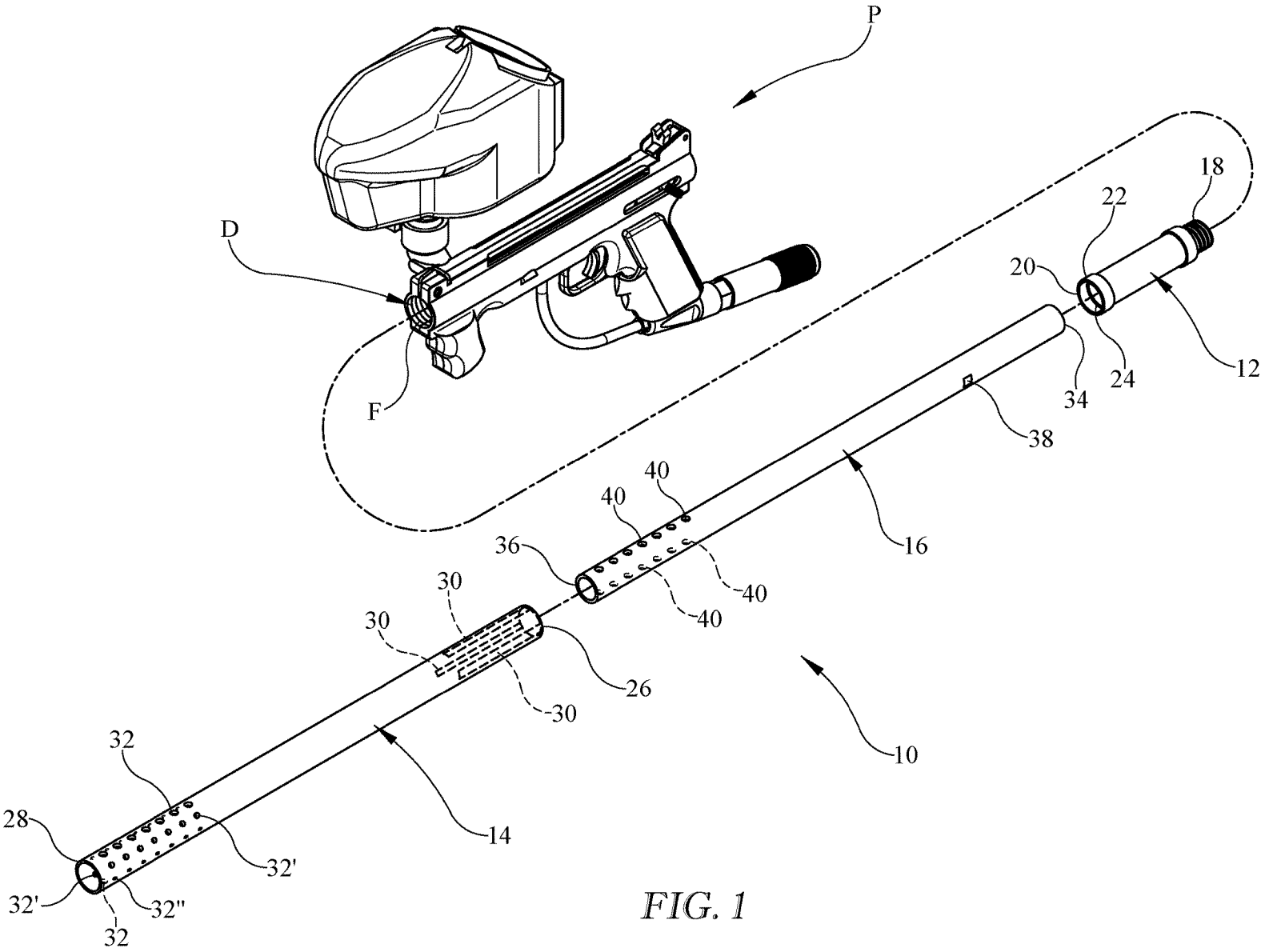
FIG. 1 is an exploded perspective view of the paintball gun barrel with variable sized magna ports of the present invention.
Figure 2:
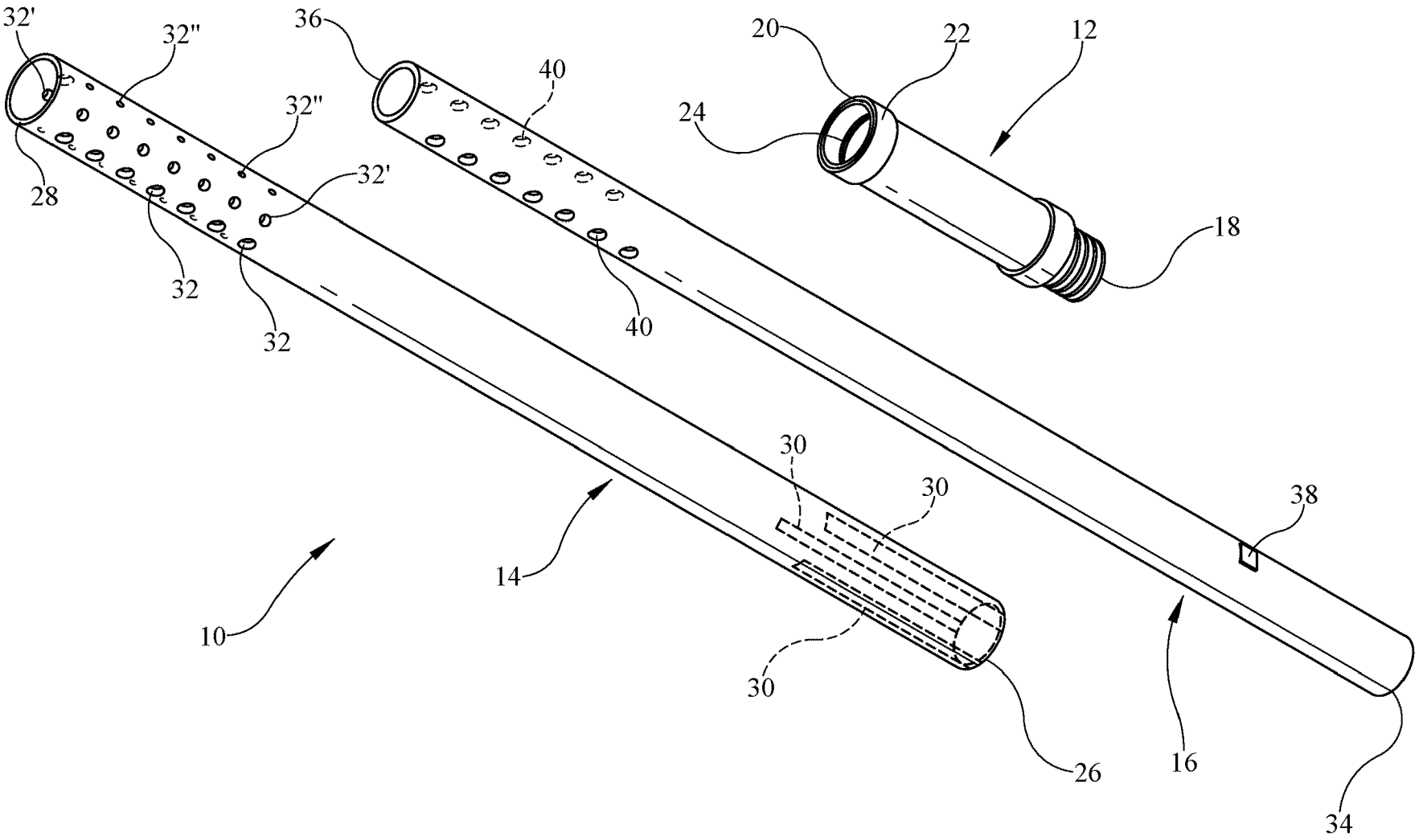
FIG. 2 is a perspective view of the various components of the paintball gun barrel system.
Figure 3:
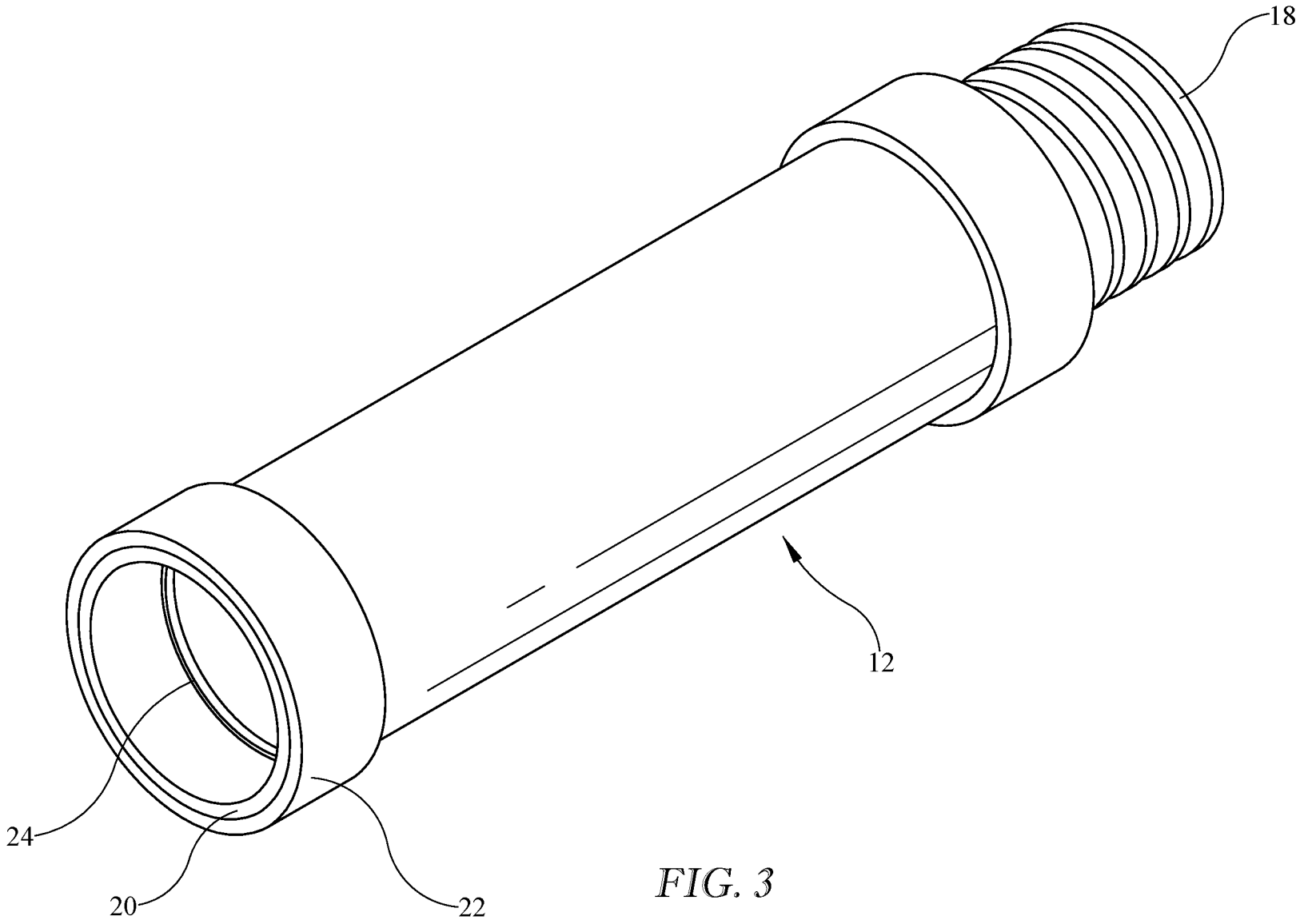
FIG. 3 is a perspective view of the barrel back of the paintball gun barrel system.
Figure 4:
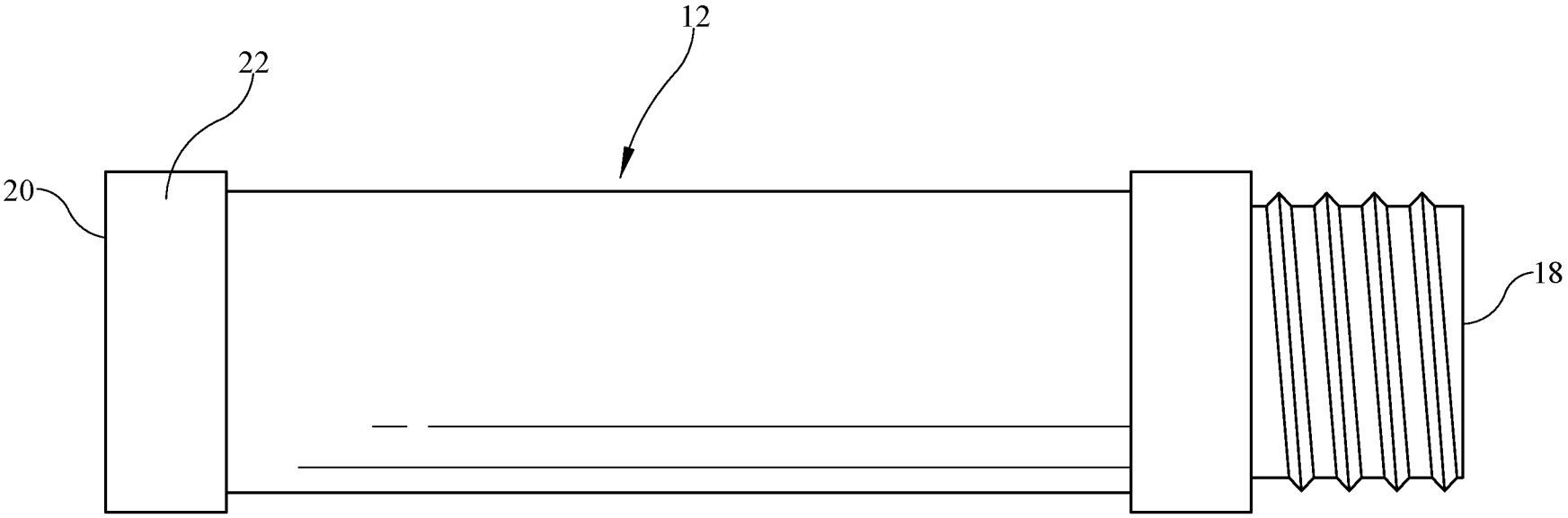
FIG. 4 is a side view of the barrel back of the paintball gun barrel system.
Figure 5:
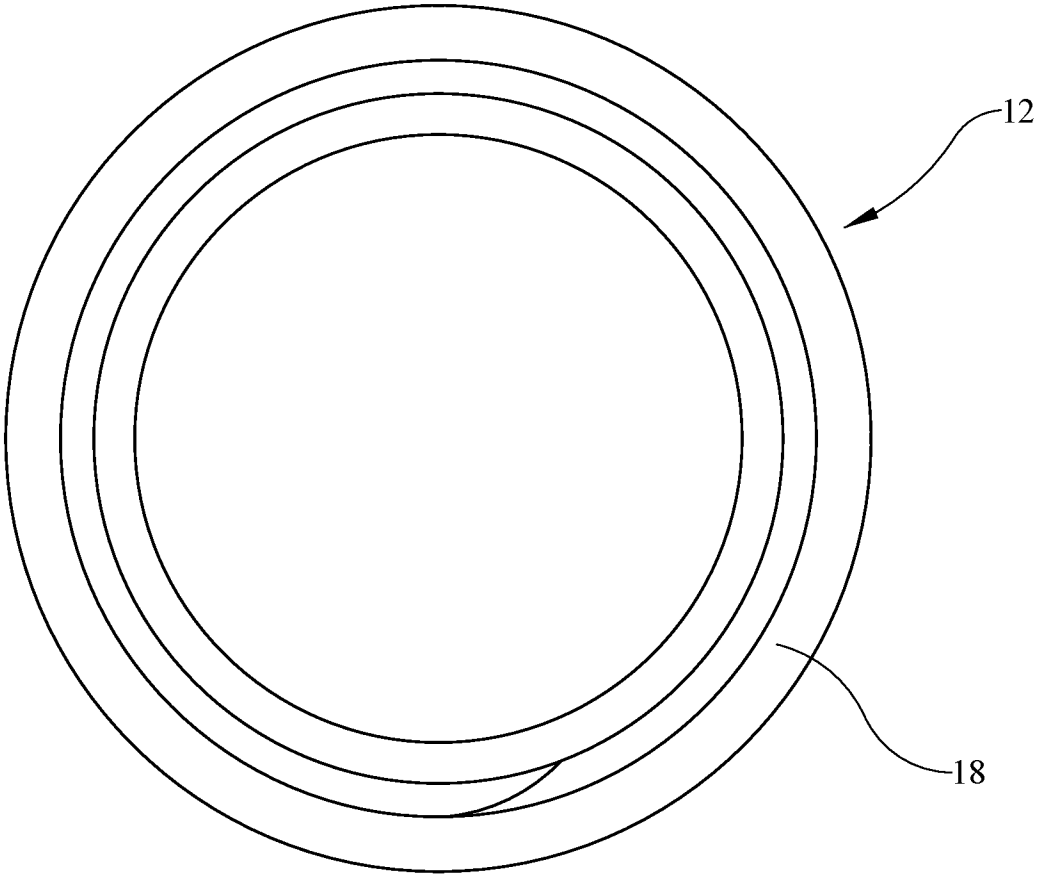
FIG. 5 is an end view of the barrel back of the paintball gun barrel system.
Figure 6:
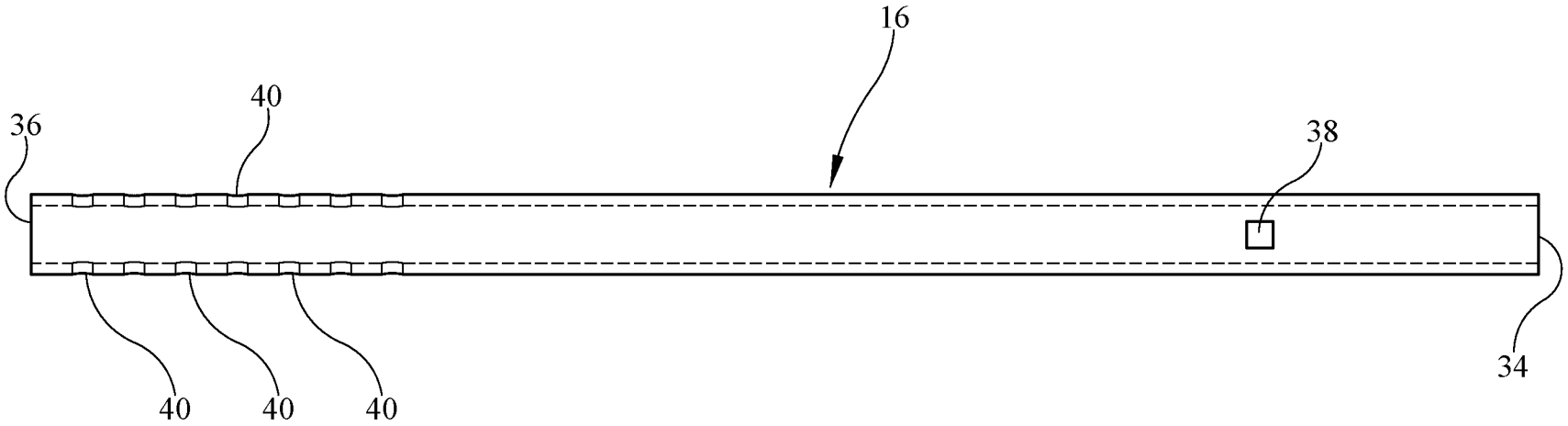
FIG. 6 is a side view of the barrel insert of the paintball gun barrel system.
Figure 7:
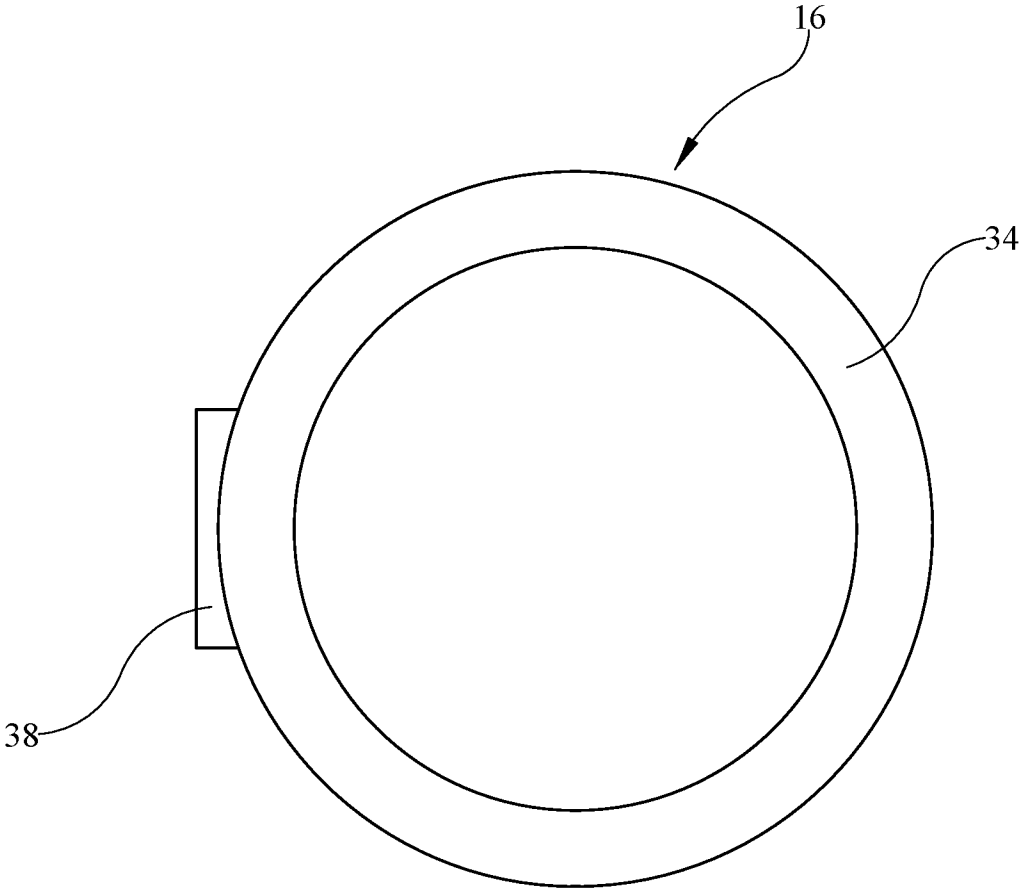
FIG. 7 is an end view of the barrel insert of the paintball gun barrel system.
Figure 8:
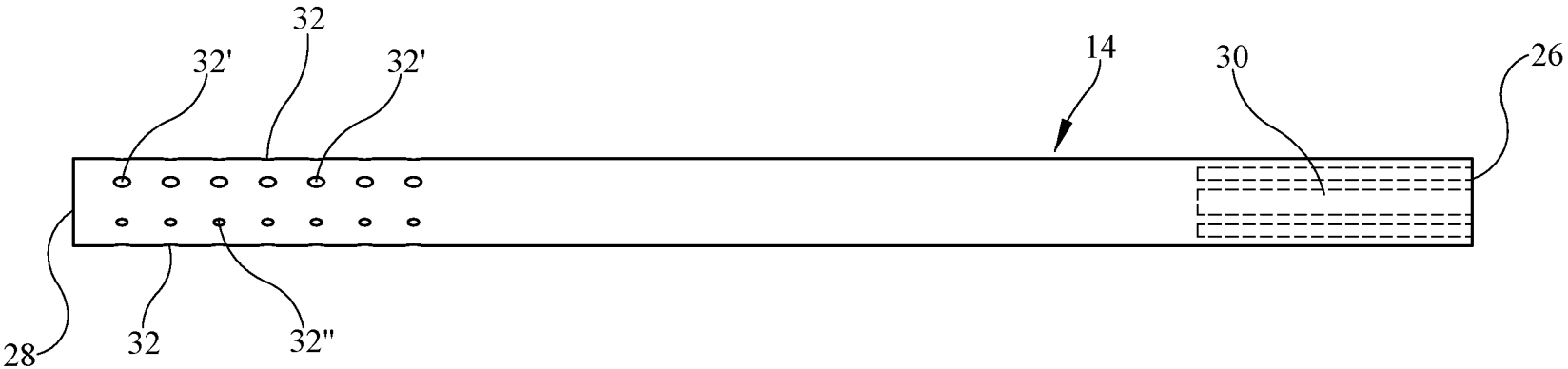
FIG. 8 is a side view of the barrel tip of the paintball gun barrel system.
Figure 9:
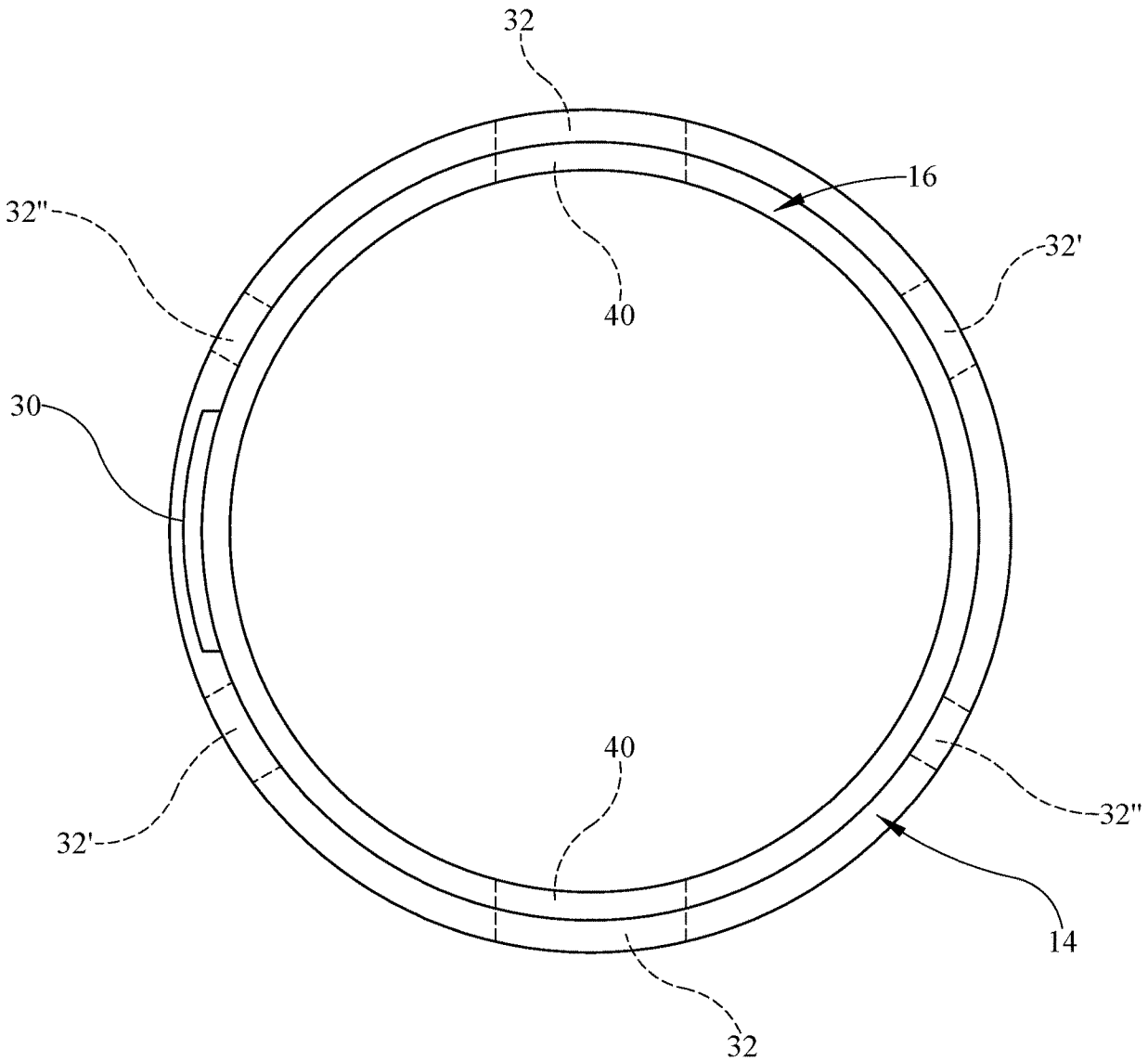
FIG. 9 is an end view of the barrel tip of the paintball gun barrel system when viewed from the barrel tip's coupling end.

Referring now to the drawings, it is seen that the paintball gun barrel with variable sized magna ports of the present invention, generally denoted by reference numeral 10, is comprised of three main components, a barrel back 12, a barrel tip 14 that attaches to the barrel back 12, and a barrel insert 16 that is received within the attached barrel back 12-barrel tip 14 combination, all of which have hollow interiors.

The barrel back 12 is a relatively short tubular member that has a first or threaded end 18 and an opposing second or magnet end 20. The threaded end 18 of the barrel back 12 is threadably received within the discharge port D of a paintball gun P. The magnet end 20 of the barrel back 12 has one or more magnets 22 attached thereto, circumferentially encircling the magnet end 20, the magnet 22, being of any appropriate shape, such as a ring magnet (illustrated) or a series of round or rectangular magnets circumferentially located at the magnet end 20. The magnet 22 is of any appropriate magnetic material such as being a rare earth permanent magnet. A seat 24 is also located at the magnet end 20 of the barrel tip 14, the seat 24 being the inner surface of which is magnetized. The coupling end 26 of the barrel tip 14 is either made from a magnetically attractive material or has a layer of magnetically attractive material (not illustrated) encircling an outer surface thereof.

The barrel tip 14 is a medium length tubular member that has a coupling end 26 and a port end 28. The coupling end 26 of the barrel tip 14 has a series of channels 30 located on an inner surface thereof, extending from the coupling end 26 toward the port end 28. A series of first ports 32 are located on the barrel tip 14 proximate the port end 28 thereof, while a series of second ports 32' are also located on the barrel tip 14 proximate the port end thereof, each second port 32' radially coextensive with the one of the first ports 32. A series of third ports 32" may also located on the barrel tip 14 proximate the port end thereof, each third port 32' radially coextensive with the one of the first ports 32 and their corresponding second ports 32'. The first series of ports 32 is of a different size relative to the second series of ports 32' and the third series of ports 32" (if provided) and the second series of ports 32' are each of a different size relative to the first series of ports 32. As seen, each series of ports 32, 32', and 32" is disposed on a longitudinal line-however, it is expressly understood that each series of ports 32, 32', and 32'" may be on a single radial line (radially encircling) on the barrel tip 14 without also being longitudinally disposed. A series of channels 30 is provided so that there is at least one channel 30 longitudinally aligned with each port 32, 32', and 32". A channel 30 may also be located along a line where there is no porting (null porting) on the barrel tip 14.

The barrel back 12 and the barrel tip 14 are coupled with one another by inserting the coupling end 26 of the barrel tip 14 into the magnetized seat 24. As the coupling end 26 of the barrel tip 14 is either made from or layered with a magnetically attractive material, the coupling end 26 of the barrel tip 14 is magnetically coupled to the magnet end 20 of the barrel back 12, the magnet(s) 22 being of sufficient magnetic strength to hold the two units 12 and 14 firmly together. Once the barrel back 12 and the barrel tip 14 are magnetically coupled to one another, they form a continuous hollow interior that has uniform inside diameter. It is recognized that the magnet(s) and the pocket may be located on the barrel tip and the distal end (opposite the threaded end) is made from or layered with a magnetically attractive material, the two configurations being equivalents of one another.

The barrel back 12 and the barrel tip 14 are made from any appropriate material, such as aluminum, or to save weight from a sturdy plastic or composite material. The inner diameter of the barrel back 12 and the inner diameter of the barrel tip 14 are substantially similar other than at the seat 24 of the barrel back 12, which seat 24 has a greater inside diameter. The two coupled units 12 and 14 form a hollow interior.

The barrel insert 16 is a relatively long and relatively thin tubular member made from aluminum or other similar material. The barrel insert 16 has a breach end 34 and a muzzle end 36. One or more pegs 38 are located on an outer surface of the barrel insert 16 slightly offset from the breach end 34 thereof—although the peg may be located more medially along the barrel insert. The inner surface of the barrel insert 16 may be highly polished or may be coated with nickel or tungsten disulfide or other similar friction reducing material. A series of fourth ports 40 is located on the barrel insert 16 proximate the muzzle end 36 thereof. The series of fourth ports 40 correspond with either one of the series of first ports 32, second ports 32', or third ports 32''' or with a null port (barrel tip is solid when overlaid on the fourth ports 40) located on the barrel tip 14 when the units are combined as more fully explained below. The inside diameter of the barrel insert 16 is the bore of the overall paintball gun P through which the paintball is fired. This inside diameter may be constant throughout the bore's length or may taper outwardly in proceeding from the breach end 34 to the muzzle end 36. The outside diameter of the barrel insert 16 is sized to be slightly smaller than the connected barrel back 12 and barrel tip 14 so as to be snugly received within the connected barrel back 12 and barrel tip 14 as more fully explained below.

In order to use the paintball gun barrel with variable sized magna ports 10 of the present invention, the barrel back 12 is mated with the paintball discharge port D of the paintball gun P by threadably mating the male threading on the threaded end 18 of the barrel back 12 with the corresponding female threading F on thee discharge port D of the paintball gun P. A barrel insert 16 is selected based on the needed bore size (inner diameter of the barrel insert 16). The breach end 34 of the barrel insert 16 is inserted into the seat 24 of the barrel back 12. Once the barrel tip 14 is so seated, the magnet(s) 22 on the barrel back 12 magnetically couple with the magnetically attractive material of the coupling end 26 of the barrel tip 14, thereby firmly coupling the barrel back 12 with the barrel tip 14.

A barrel tip 14 is selected. The coupling end 26 of the barrel tip 14 is positioned to receive the muzzle end 36 of the barrel insert 16 and is slid over the barrel insert 16. The channel 30 of the barrel tip 14 that corresponds to the desired porting 32, 32', or 32" is aligned with the peg 38 of the barrel insert 16 so that the peg 38 enters a respective one of the channels 30—the peg 38 and channel 30 each being dimensioned so that there is a snug fit of peg 38 within its respective channel 30. If the porting size of the first series of ports 32 is desired, then the channel 30 or channels 30 that longitudinally align with the first series of ports 32 receives the pegs 38. In this configuration, the first series of ports 32 each overlay one of the fourth ports 40 on the barrel insert 16 so that the first series of ports 32 determines the size of the porting for the barrel insert 16. Similarly, if the porting size of the second series of ports 32' is desired, then the channel 30 or channels 30 that longitudinally align with the second series of ports 32' receives the pegs 38. In this configuration, the second series of ports 32' each overlay one of the fourth ports 40 on the barrel insert 16 so that the second series of ports 32' determines the size of the porting for the barrel insert 16 and if the porting size of the third series of ports 32" is desired, then the channel 30 or channels 30 that longitudinally align with the third series of ports 32" receives the pegs 38. In this configuration, the third series of ports 32" each overlay one of the fourth ports 40 on the barrel insert 16 so that the third series of ports 32" determines the size of the porting for the barrel insert 16. If no porting is desired, the channel or channels 30 that longitudinally align with no ports receives the pegs 38, In this configuration, a solid portion of the barrel tip 14 overlays the fourth ports 40 thereby closing the fourth ports 40 and eliminating porting.

The pegs 38 within their respective channels 30 provide a steady securement of the coupled barrel back 12-barrel tip 14 combination with the barrel insert 16 and prevent rotation of the barrel back 12-barrel tip 14 combination about the barrel insert 16 and assure that the selected ports 32, 32', 32" or null ports and the fourth ports 40 are aligned with one another. When the paintball gun P fires a paintball, the paintball enters the hollow interior of the barrel insert 16 at the breach end 34, travels through the hollow interior of the barrel insert 16, and is discharged through the muzzle end 36. Excess gas that is used to fire the paintball escapes out through the selected ports 32, 32', or 32" via the overlaid fourth ports 40, unless the null ports are selected in which case the gas escapes out of the muzzle end 36 in the usual way.

In order to change bore size of the barrel proper, the barrel insert 16 is pulled with sufficient force to overcome its magnetic coupling with the barrel back 12 and is also slid out of the barrel tip 16-pegs 38 removed from their selected channels 30. A new barrel insert 16 is attached to the overall paintball gun P as described above. If the porting configuration on the new barrel insert 16 changes, then a new barrel tip 14 is also retrieved so that the new barrel tip 14 has a porting configuration that matches the porting configuration on the new barrel insert 16. In either case, the barrel tip 14 and barrel insert are again coupled as described above. This operation is quick, easy, and efficient.

In order to change porting for a given barrel tip 14 without changing the barrel insert 16, the barrel tip 14 is pulled a sufficient distance to extract the pegs 38 from the channels 30 in which they seat, the barrel tip 14 is rotated until the desired ports (or null ports) align with the fourth ports 40 and then the barrel tip 14 is pushed until the pegs 38 are received within the channels 30 that longitudinally align with the selected ports.

The outer surfaces of the barrel back 12-barrel tip 14 combination can be aesthetically decorated as desired. This can include making the combination in different colors, in camouflage livery, with corporate logos thereon or other forms of advertising, etc.

Figure 10:
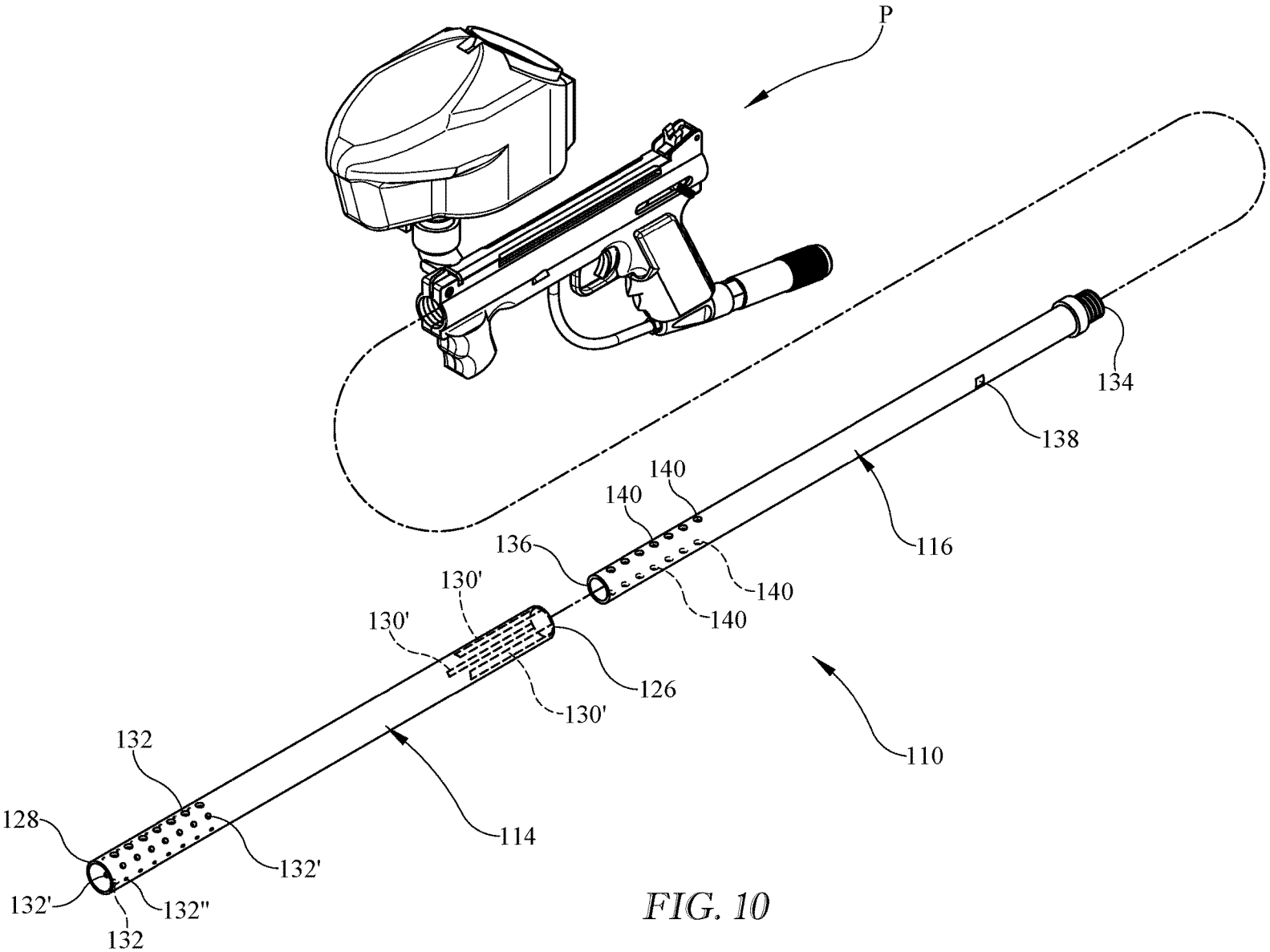
FIG. 10 is a perspective view of the paintball gun barrel with variable sized magna ports of the present invention implemented on a standard paintball gun.

I have described the paintball gun barrel with variable sized magna ports in relation to my previous paintball gun barrel system. However, as seen in FIG. 10, the system works equally well with conventional paintball gun barrels 116. As seen, the paintball gun barrel with variable sized magna ports 110 uses a standard barrel 116 that is attached to a paintball gun P in the usual way. Pegs 138 are provided on the outer surface of the barrel 116 near the breach end 134 thereof.

The coupling end 126 of the barrel tip 114 has a series of channels 130 located on an inner surface thereof, extending from the coupling end 126 toward the port end 128. A series of first ports 132 are located on the barrel tip 114 proximate the port end 128 thereof, while a series of second ports 132' are also located on the barrel tip 114 proximate the port end thereof, each second port 32' radially coextensive with the one of the first ports 132. A series of third ports 132" may also located on the barrel tip 114 proximate the port end thereof, each third port 132' radially coextensive with the one of the first ports 132 and its corresponding second port 132'. The first series of ports 132 is of a different size relative to the second series of ports 132' and the third series of ports 132" (if provided) and the second series of ports 132' is of a different size relative to the third series of ports 132". As seen, each series of ports 132, 132', and 132" is disposed on a longitudinal line-however, it is expressly understood that each series of ports 132, 132', and 132" may be on a single radial line (radially encircling) on the barrel tip 114 without also being longitudinally disposed. Located on the same line for at least one of each of the ports 132, 132', and 132" is a channel 130. A channel 130 may also be located along a line where there is no porting (null porting) on the barrel tip 114.

The coupling end 126 of the barrel tip 114 is positioned to receive the muzzle end 136 of the barrel 116 and is slid over the barrel 116. The channels 130 of the barrel tip 114 that correspond to the desired porting are aligned with the pegs 138 of the barrel 116 so that the pegs 138 each enter a respective one of the channels 130—the pegs 138 and channels 130 being dimensioned so that there is a snug fit of peg 138 within its respective channel 130. If the porting size of the first series of ports 132 is desired, then the channel 130 or channels 130 that longitudinally align with the first series of ports 132 receives the pegs 138. In this configuration, the first series of ports 132 each overlay one of the fourth ports 140 on the barrel 116 so that the first series of ports 132 determines the size of the porting for the barrel 116. Similarly, if the porting size of the second series of ports 132' is desired, then the channel 130 or channels 130 that longitudinally align with the second series of ports 132' receives the pegs 138. In this configuration, the second series of ports 132' each overlay one of the fourth ports 140 on the barrel 116 so that the second series of ports 132' determines the size of the porting for the barrel 116 and if the porting size of the third series of ports 132" is desired, then the channel 130 or channels 130 that longitudinally align with the third series of ports 132" receives the pegs 138. In this configuration, the third series of ports 132" each overlay one of the fourth ports 140 on the barrel 116 so that the third series of ports 132" determines the size of the porting for the barrel 116. If no porting is desired, the channels 130 that longitudinally align with no ports receives the pegs 138, In this configuration, a solid portion of the barrel tip 114 overlays the fourth ports 140 thereby closing the fourth ports 140 and eliminating porting.

In order to change porting for a given barrel tip 114, the barrel tip 114 is pulled a sufficient distance to extract the pegs 138 from the channels 130 in which they rest, rotate the barrel tip 114 until the desired ports (or null ports) align with the fourth ports 40 and then push the barrel tip 114 until the pegs 138 are received within the channels 130 that longitudinally align with the selected ports.

While the invention has been particularly shown and described with reference to an embodiment thereof, it will be appreciated by those skilled in the art that various changes in form and detail may be made without departing from the spirit and scope of the invention.

I claim:

1. A paintball gun barrel system configured to be attached to a paintball gun having a main body with a paintball discharge port, the paintball gun barrel system comprising:

a hollow tubular barrel back having a first end that is adapted to be removably attached to the discharge port of the paintball gun and an opposing second end;

a magnet located on the second end of the barrel back;

a hollow tubular barrel tip having a first inner surface, a coupling end and a port end, the coupling end of the barrel tip having magnetically attractive material thereat, the coupling end received within a seat on the second end of the barrel back such that the coupling end is magnetically coupled to the magnet, the coupled barrel tip and barrel port forming a continuous first hollow interior;

a first channel disposed within the first inner surface of the barrel tip extending from the coupling end toward the port end;

a second channel disposed within the first inner surface of the barrel tip extending from the coupling end toward the port end, a peg received within one of the first and second channels when the barrel insert is received within the first hollow interior, the second channel spaced apart from the first channel;

a first port located on the barrel tip proximate the port end and longitudinally aligned with the first channel, the first port being of a first size;

a second port located on the barrel tip proximate the port end and longitudinally aligned with the second channel and radially spaced apart from the first port, the second port being of a second size that is different relative to the first size; and a hollow tubular barrel insert having a second inner surface, an outer surface, a second hollow interior, a breach end and a muzzle end, a peg on an outer surface of the tubular barrel and a third port proximate the muzzle end, the barrel insert is received within the first hollow interior formed by the coupled barrel back and barrel tip such that the breach end of the barrel insert abuts the paintball gun and such that the peg is received within either the first channel and the first port overlays the third port or the peg is received with second channel and the second port overlays the third port.

2. The paintball barrel system as in claim 1 wherein the magnet is a ring magnet.

3. The paintball barrel system as in claim 1 further comprising a third channel disposed within the first inner surface of the barrel tip extending from the coupling end toward the port end such that the peg may be received within the third channel when the barrel insert is received within the first hollow interior formed by the coupled barrel back and barrel tip.

4. The paintball barrel system as in claim 1 wherein the barrel insert has a first inside diameter at the breach end and a second inside diameter located at the muzzle end such that the second diameter is greater than the first diameter.

5. The paintball barrel system as in claim 1 wherein the second inner surface of the barrel insert has a friction reducing coating thereon.

6. The paintball barrel system as in claim 1 in combination with the paintball gun.

7. The paintball barrel system as in claim 6 wherein the magnet is a ring magnet.

8. The paintball barrel system as in claim 6 further comprising a third channel disposed within the first inner surface of the barrel tip extending from the coupling end toward the port end such that the peg may be received within the third channel when the barrel insert is received within the first hollow interior formed by the coupled barrel back and barrel tip.

9. The paintball barrel system as in claim 6 wherein the barrel insert has a first inside diameter at the breach end and a second inside diameter located at the muzzle end such that the second diameter is greater than the first diameter.

10. The paintball barrel system as in claim 6 wherein the second inner surface of the barrel tip has a friction reducing coating thereon.

11. A paintball gun barrel system configured to be attached to a paintball gun having a main body with a paintball discharge port, the paintball gun barrel system comprising:

a hollow tubular barrel having breach end that is adapted to be removably attached to the discharge port of the paintball gun, the barrel also having an opposing muzzle end, and an outer surface, a peg on an outer surface of the barrel and having a first port proximate the muzzle end;

a hollow tubular barrel tip having a first inner surface, a coupling end and a port end;

a first channel disposed within the first inner surface of the barrel tip extending from the coupling end toward the port end; a second channel disposed within the first inner surface of the barrel tip extending from the coupling end toward the port end, the second channel spaced apart from the first channel;

a second port located on the barrel tip proximate the port end and longitudinally aligned with the first channel, the second port being of a first size;

a third port located on the barrel tip proximate the port end and longitudinally aligned with the second channel and radially spaced apart from the second port, the third port being of a second size that is different relative to the first size; and wherein the barrel is received within the barrel tip so that the peg is received within either the first channel and the second port overlays the first port or the peg is received the second channel and the third port overlays the first port.

12. The paintball barrel system as in claim 11 further comprising a third channel disposed within the first inner surface of the barrel tip extending from the coupling end toward the port end such that the peg may be received within the third channel when the barrel is received within the first hollow interior of the barrel tip.

13. The paintball barrel system as in claim 11 wherein the barrel has a first inside diameter at the breach end and a second inside diameter located at the muzzle end such that the second diameter is greater than the first diameter.

14. The paintball barrel system as in claim 11 wherein the second inner surface of the barrel has a friction reducing coating thereon.

15. The paintball barrel system as in claim 11 in combination with the paintball gun.

16. The paintball barrel system as in claim 15 further comprising a third channel disposed within the first inner surface of the barrel tip extending from the coupling end toward the port end such that the peg may be received within the third channel when the barrel is received within the first hollow interior of the barrel tip.

17. The paintball barrel system as in claim 15 wherein the barrel has a first inside diameter at the breach end and a second inside diameter located at the muzzle end such that the second diameter is greater than the first diameter.

18. The paintball barrel system as in claim 15 wherein the second inner surface of the barrel has a friction reducing coating thereon.

* * * * *